US005121666A

United States Patent [19]

Valen

[11] Patent Number: 5,121,666

[45] Date of Patent: Jun. 16, 1992

[54] WEAR PAD ASSEMBLY ATTACHABLE TO DRUM STRUCTURE

[76] Inventor: Jonathan Valen, 1309 Amherst, Apt. 210, West Los Angeles, Calif. 90025

[21] Appl. No.: 665,273

[22] Filed: Mar. 6, 1991

[51] Int. Cl.[5] ..... G10D 13/08

[52] U.S. Cl. ..... 84/453; 84/411 R

[58] Field of Search ..... 84/411 R, 411 A, 411 M, 84/411 P, 415, 452 P, 453

[56] References Cited

U.S. PATENT DOCUMENTS

| | | | |
|---|---|---|---|
| 312,804 | 2/1885 | Brown | 84/453 |
| 504,910 | 9/1893 | Cox | 84/411 R |
| 772,743 | 10/1904 | Oschatz | 84/411 R |
| 2,779,227 | 1/1957 | Slingerland, Jr. | 84/411 R |
| 3,981,220 | 9/1976 | Clark | 84/415 |
| 4,283,985 | 8/1981 | Famularo | 84/411 R |
| 4,344,349 | 8/1982 | Cordes | 84/411 R |

*Primary Examiner*—W. B. Perkey
*Assistant Examiner*—Cassandra C. Spyrou
*Attorney, Agent, or Firm*—William W. Haefliger

[57] ABSTRACT

A drum stick wear pad assembly attachable to drum structure including an arcuate rim, comprising: a non-metallic relatively hard pad elongate with primary curvature in the length direction of the drum arcuate rim; a rigid mount for the pad to hold the pad presented otuwardly above the rim; and the mount configured to be attachable to the drum structure in space relation to the rim.

18 Claims, 2 Drawing Sheets

FIG. 4.
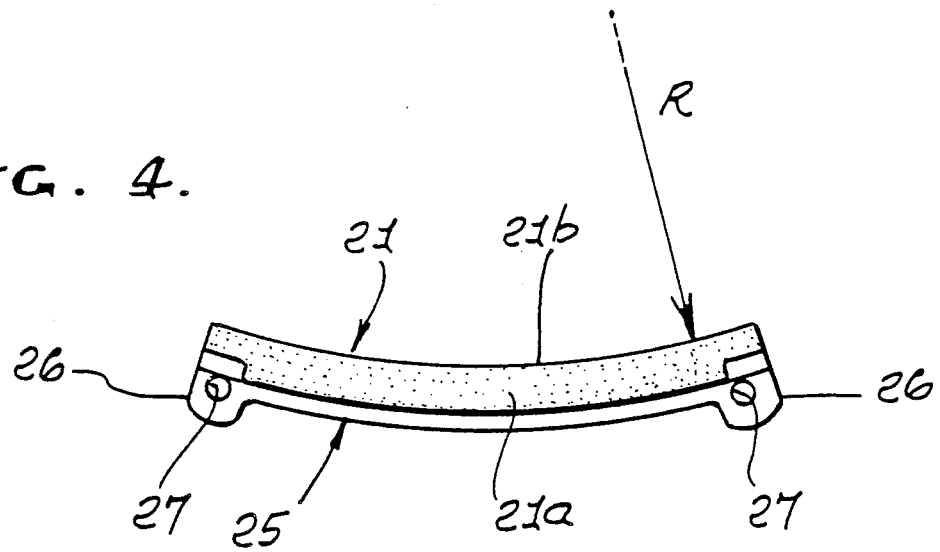
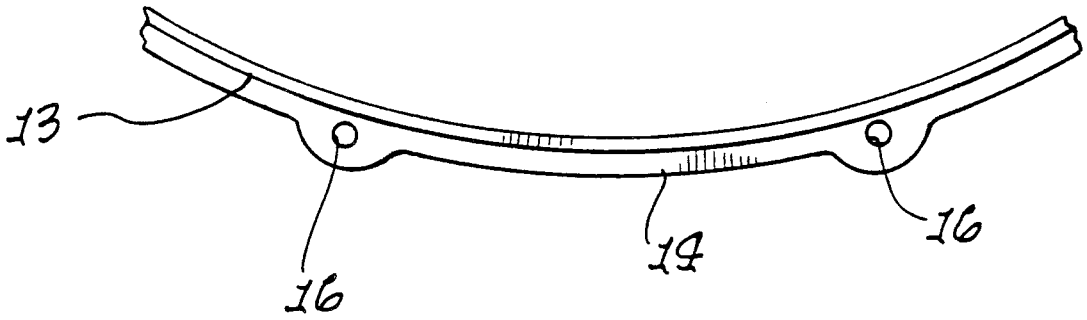
FIG. 5.

WEAR PAD ASSEMBLY ATTACHABLE TO DRUM STRUCTURE

BACKGROUND OF THE INVENTION

This invention relates generally to prevention of drum stick breakage or excessive wear, due to impact against drum metallic rims. More particularly, it concerns a highly advantageous, simple, easily attached wear pad assembly to be struck by drum sticks, and easily attachable to and removable from a drum at the rim thereof.

The problem of drum stick wear and breakage is substantial. The more breakage that occurs, the more cost is involved in replacing them. Such wear and breakage occurs and persists primarily as a result of impacts against the drum rim, for "rim shot" acoustical effects, which are desirable. There is need for means attachable to a drum that will minimize such wear and breakage problems, while retaining the acoustical effects of rim shots and while allowing "playing" of the drum in the same manner as before.

SUMMARY OF THE INVENTION

It is a major object of the invention to provide a drum wear pad assembly that is constructed and operated in such manner as to overcome the described problems. As will be seen, the assembly herein described solves the problem and also provides additional advantages in construction, mode of operation (including connection to the drum) and results.

Basically, the present drum stick wear pad assembly is attachable to a drum rim, and includes a) a non-metallic relatively hard pad elongated with primary curvature in the length direction of the drum arcuate rim, b) a rigid mount for the pad to hold the pad presented outwardly above the rim, c) the mount configured to be attachable to the drum structure in spaced relation to the rim.

As will be seen, the pad typically may have secondary curvature to extend over the top of the drum rim; and for this surface the pad may have inverted U-shaped cross-sections in planes normal to lengthwise extent of the pad in the primary curvature direction. The pad itself may advantageously consist of hard leather, closely acoustically coupled to the mount which is metallic and acoustically coupled to the rim, whereby drum stick striking of the pad transmits shock waves to the metallic rim to produce "rim shot" acoustic effect.

Another object is to provide the mount to be elongated with primary curvature in the length direction of said arcuate rim, the mount supported on the rim; and the mount typically having inverted U-shape cross-sections in planes normal to lengthwise extent of the mount. In this regard, the pad typically also has inverted U-shape, and is attached to the mount, whereby the pad fits closely over the inverted U-shape of the mount.

A further object is to provide the mount with an angled foot attachable to the drum, the foot typically attachable to a drum clamp such as a tuning rod, and a drum flange, to hold the mount in tight engagement with the rim, for acoustic coupling as referred to.

These and other objects and advantages of the invention, as well as the details of an illustrative embodiment, will be more fully understood from the following specification and drawings, in which:

DRAWING DESCRIPTION

FIG. 4 is a plan view of the FIG. 2 assembly;

FIG. 5 is a plan view of a snare drum rim, to which the wear pad assembly is attachable.

DETAILED DESCRIPTION

Figure 1:
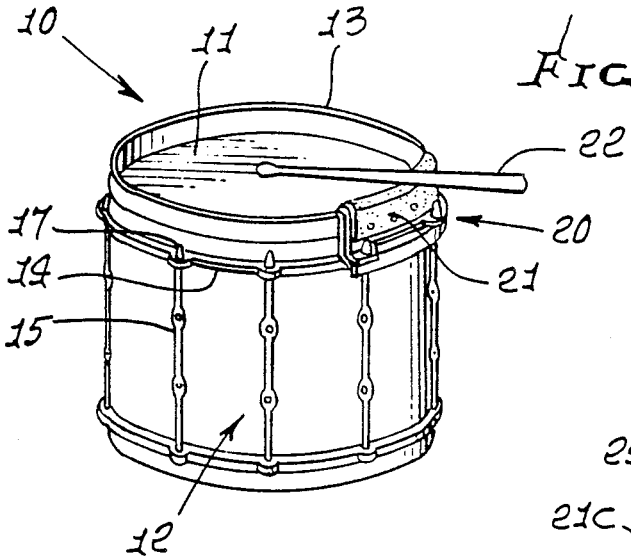
FIG. 1 is a perspective fragmentary view of a drum to which the invention is applied.
Figure 2:
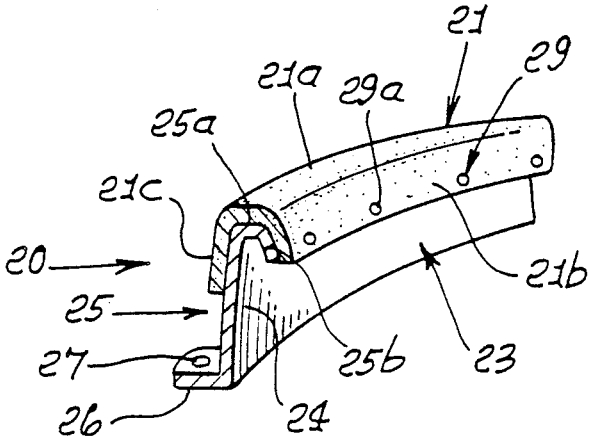
FIG. 2 is an enlarged perspective view of the wear pad assembly.

In the drawings, a drum 10 has a head 11, a shell or body 12, and a metallic annular rim 13. Projecting outwardly from the shell or body is a flange or flanges 14, below the level of the rim. Tuning key rods 15 extend parallel to the shell 12, and project through openings 16 in the flange or flanges. Tuning keys 17 have stems thread-connected to the rods, and may be tightened or loosened, to vary loading on the drum.

The wear pad assembly 20 of the invention is attachable to the drum structure, including the arcuate (annular) metallic rim 13. The assembly basically includes a non-metallic, relatively hard pad 21, elongated with primary curvature in the length direction of the arcuate rim. Thus, the pad may extend (along the rim) circularly, at a radius R, indicated in FIG. 4, from the drum axis. The pad may advantageously consist of hard leather, or hard leather with a thin rubber coat, on which a drum stick or sticks 22 strike, to minimize breakage of the sticks. Plastic material is also usable.

Figure 3:
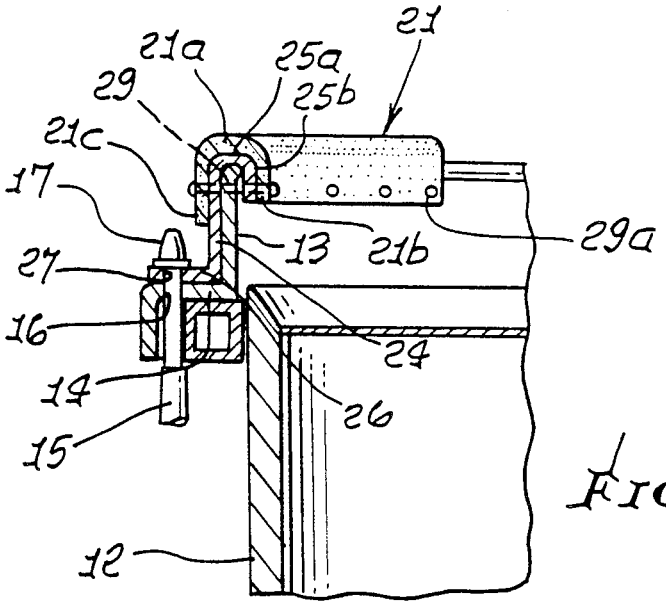
FIG. 3 is a vertical section taken through the FIG. 1 assembly.

A rigid mount, as for example at 23, is provided for the pad 21, to hold the pad presented outwardly from and above the rim; however, the mount acoustically couples the pad to the rim for desired "rim shot" acoustic effect, when struck by the stick 22. At the same time, the use of the pad minimizes wear on the drum stick or sticks 100 which impact the pad. The illustrated mount 23, typically metallic, (for example aluminum or other metal) includes a wall portion 24 extending upwardly generally parallel to rim 13 and closely adjacent the outer side of the rim. It also includes an upper "hook" portion 25 that hooks over the top of the rim as shown. See hook top **25*a* and inner side 25*b*, whereby the portion 25 has inverted U-shape cross-sections in planes normal to lengthwise extent of the mount. (See the plane of FIG. 3, for example). The mount also includes a turned foot or flange 26, (or feet or flanges), that projects outwardly away from the rim at a location or locations adjacent the drum flange 14. The foot or feet define at least one through opening 27 registering with opening 16 or openings 16 in the flange. See FIGS. 4 and 5 showing two openings 27 that register with openings 16. Upon attachment of the mount to the drum, the tuning key stems pass through openings 16 and 27, and the keys 17 are tightened to clamp the foot or feet 26 to the flange or flanges 14, the mount then being acoustically coupled to the rim. Keys 17** therefore have multiple functions.

Pad 21 fits over the mount upper extent, and typically also has inverted U-shape to closely fit the mount hook portions **25*a* and 25*b*. See pad "hook" portions 21*a* and 21*b* respectively engaging 25*a* and 25*b*. The pad also has an outer wall 21*c* engaging mount wall 24, as shown, and fasteners 29 attach 21*b* to 25*b* to retain the pad closely acoustically coupled to the mount. Such fasteners have heads 29***a* engaging 21*b* as shown.

Accordingly, the pad 21 and mount 23 both have primary curvature in the length direction of the arcuate rim; and both have inverted U-shape secondary curvature in planes normal to the rim lengthwise extent. The wear pad assembly typically has length between about 4 and 8 inches; however, it may extend to any selected lengths along the rim 13, as for example completely about the rim (360°), or only partly along and about the rim.

I claim:

1. A drum stick wear pad assembly attachable to a drum structure including an arcuate rim having a primary curvature, comprising:

(a) a non-metallic, relatively hard pad elongated along the primary curvature of the arcuate rim, (b) a rigid mount for the pad to hold the pad presented outwardly above the arcuate rim, (c) the mount sized to be attachable to the drum structure in spaced relation to the rim.

2. The assembly of claim 1 wherein the arcuate rim has a top, and said pad has secondary curvature to extend over the arcuate rim top.

3. The assembly of claim 2 wherein the pad has inverted U-shaped cross-sections in planes normal to a tangent to the arcuate rim.

4. The assembly of claim 1 wherein the pad consists of hard leather.

5. The assembly of claim 1 wherein said rigid mount is also elongated along the primary curvature of said arcuate rim.

6. The assembly of claim 5 wherein said mount has inverted U-shape cross-sections in planes normal to lengthwise extent of the mount.

7. The assembly of claim 6 wherein the mount is metallic.

8. The assembly of claim 6 wherein the pad fits over said U-shape of the mount.

9. The assembly of claim 8 wherein the pad also has inverted U-shape, and is attached to the mount.

10. The assembly of claim 9 wherein the pad consists of leather.

11. The assembly of claim 1 wherein the mount has an angled foot attachable to a clamp defined by said drum structure.

12. The assembly of claim 11 including said drum structure and said clamp via which the foot is connected to the drum structure.

13. The assembly of claim 8 wherein the mount has an angled foot attached to a clamp defined by said drum structure.

14. The assembly of claim 13 including said drum structure and said clamp via which the foot is connected to a metallic flange defined by the drum structure.

15. The assembly of claim 9 including said arcuate rim and wherein the mount has inner and outer walls respectively engaging opposite sides of the arcuate rim, and the pad has inner and outer walls respectively engaging said mount inner and outer walls, and fastener means passing through the mount and the pad inner and outer walls to retain the pad in direct engagement with the mount, the pad and mount having portions directly above the arcuate rim which are in interengagement, the mount directly engaging the top of the arcuate rim.

16. The assembly of claim 1 wherein the pad consists of leather with a rubber coating thereon.

17. The assembly of claim 1 wherein the pad length is at least about four inches.

18. The assembly of claim 1 including said arcuate rim and wherein the pad extends along a substantial portion of the arcuate rim.

* * * * *